US006938316B1

(12) United States Patent
Case

(10) Patent No.: US 6,938,316 B1
(45) Date of Patent: Sep. 6, 2005

(54) TRANSMISSION ASSEMBLY TOOLS

(76) Inventor: James Vernon Case, 38 Lakeview Dr., Collins, MS (US) 39428

( * ) Notice: Subject to any disclaimer, the term of this patent is extended or adjusted under 35 U.S.C. 154(b) by 103 days.

(21) Appl. No.: 10/699,420

(22) Filed: Oct. 31, 2003

(51) Int. Cl.[7] ..... B25B 27/14
(52) U.S. Cl. ..... 29/281.5; 29/235
(58) Field of Search ..... 29/281.5, 255, 29/235, 238–239, 244, 256

(56) References Cited

U.S. PATENT DOCUMENTS 4,204,306 A * 5/1980 Makuch ..... 29/281.5
4,564,994 A * 1/1986 Marx ..... 29/468
2003/0014854 A1 * 1/2003 Brown ..... 29/426.5

* cited by examiner

*Primary Examiner*—Lee D. Wilson
(74) *Attorney, Agent, or Firm*—John D. Jeter

(57) ABSTRACT

The tool set is preferably made in three pieces; a main spear that attaches to and extends from the assembly shaft that projects through a mounting wall of the transmission housing, and holds the selected assembled parts together; an alignment spear that engages one bolt hole on the assembly and passes through a hole in the housing intended for a mounting bolt; and a spacer sleeve to engage the spear and extend to part of the assembly. The main spear and spacer sleeve can be one part if preferred.

9 Claims, 6 Drawing Sheets

TRANSMISSION ASSEMBLY TOOLS

This invention relates to tools for the assembly of automatic transmissions. More particularly, but not exclusively, it relates to the automatic transmissions in Mercedes automobiles. The tools are usable with any transmission having similar elements assembled within the housing and not visible for protecting delicate parts when the related parts are mated under conditions during which critical parts can be deranged by assemblers actions when parts are moving into final positions.

BACKGROUND

During the repair of automatic transmissions, especially in the Mercedes automobile, some of the assembly is carried out with the transmission housing generally central axis in the vertical position, with the forward end facing upward. Some parts are placed in the housing, and further assembly is of such nature that the movements required may displace the previously assembled parts. The previously assembled parts cannot be inspected as assembly proceeds, or after it is completed, to assure the correctness of their positions.

The first assembled parts consists, in part, of a combination of seals and a thrust bearing ring that can cause very early failure of the transmission if they are compromised by disturbing assembly movements that occur after they are no longer visible. The problem is made more detrimental by the nature of the coming failure. The vehicle usually lasts a few miles before it has to be recovered and towed back for corrective work.

There is a need for tools that enable the assembly of the troublesome internal parts before they are installed into the housing. The needs provide the objects of the invention.

SUMMARY OF THE DISCLOSURE

Tools are provided to retain the potentially troublesome assembly in an assembled state, with the critical elements secured in position while the assembly is inserted into the housing.

BRIEF DESCRIPTION OF DRAWINGS

The transmission parts shown in the formal drawings are only those influenced by use of the assembly tooling. Any other parts of the transmission, and the housing, if presented, are in simplified form. The total transmission is a complex and intricate assembly that can confuse the purpose of the description and, if present, would add little benefit in describing points of novelty.

DETAILED DESCRIPTION OF DRAWINGS

The drawings are formal but omit many details of the related transmission that contribute nothing to the description of the points of novelty. Only parts influenced by new tooling are shown.

Figure 1:
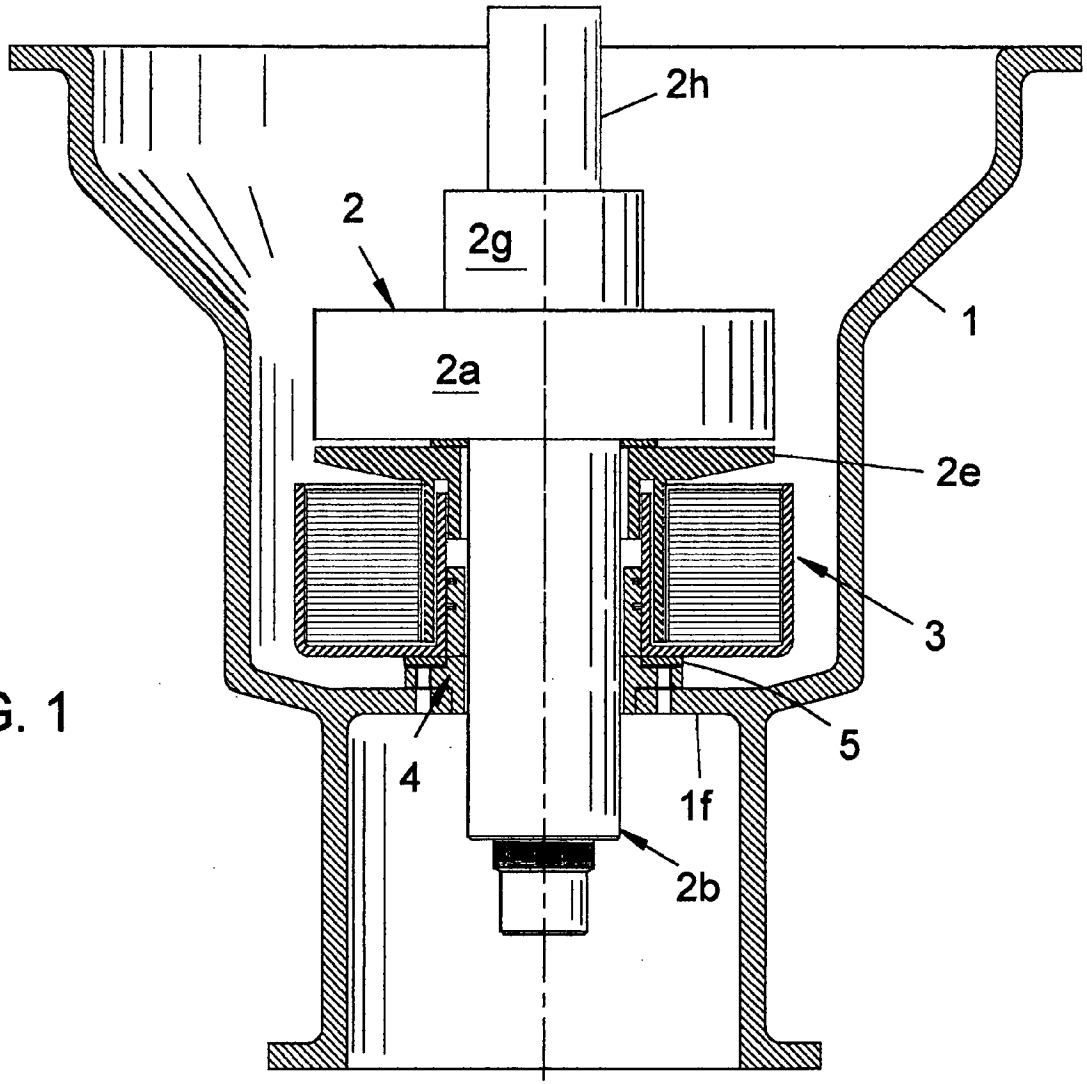
FIG. 1 is a side view, in cutaway, of the partly assembled transmission.

FIG. 1 shows the parts of the transmission assembled by prior art methods, or with the novel tooling, to present the relationships of components hard to assemble by prior art methods.

Housing 1 has a partition 1*f* that supports and fixes the positions of the oil bushing 4 which is the most troublesome part. Thrust washer 5 rests on the part 4 and is rotationally secured by a tang shown in FIG. 3 which engages a hole (not shown) in the part 4. Clutch assembly 3 is then positioned as shown and has to be placed, by prior art, into the housing and is positioned to enclose the seal rings on the bushing 4 without the benefit of vision from the side as assembly takes place, see the rings 4*a* and 4*b* of FIG. 4.

It is significant that the oil bushing has surface and fastener arrangements to mount the oil bushing on the housing. Other transmission parts supported by the bearing features of the bushing are related to the housing by way of the bushing.

Assembly 2 is then inserted along the general center line into the position shown. Assembly 2 consists of shaft 2*b*, planetary gear complex 2*a*, with engagement extension 2*e*, upwardly extending spline portion 2*g*, and finally input shaft 2*h*. The forward end of the transmission is upward. Assembly 2 is a complex mechanism made difficult to assemble by splines 2*e* which have to move through disc mating splines 3*b* (see FIG. 2) one-by-one until the position shown is achieved. The splines and disc relationship is best shown by FIG. 2.

Figure 2:
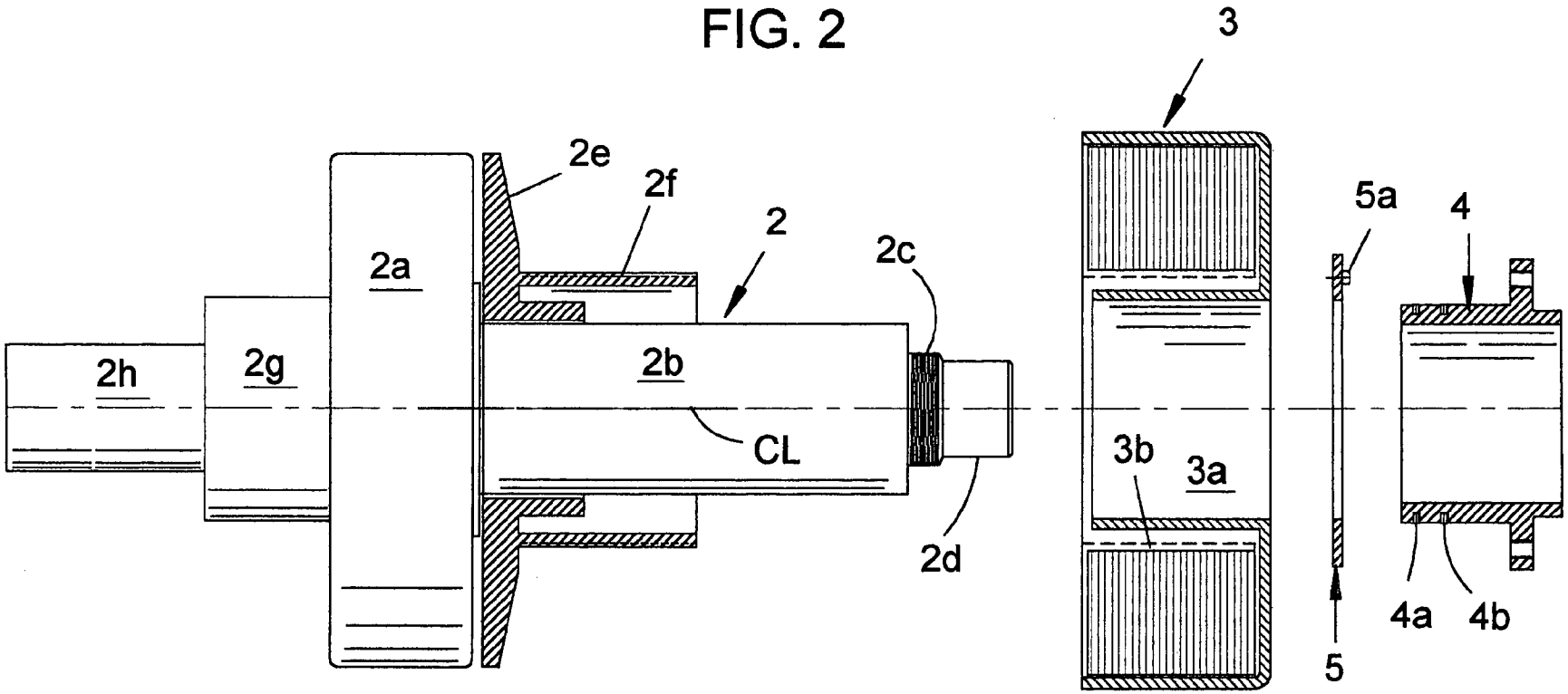
FIG. 2 is a side view partly cut away of the components with assembly problems.

FIG. 2 shows the relationships of the troublesome parts of the transmission and more clearly shows the features that present little difficulty if visible from the side while the assembly takes place outside the housing. Clutch 3 is a drum containing a series of discs that have spline matching bores 3*b*. Starting with oil bushing 4, seal rings 4*a* and 4*b* are installed and washer 5 is put in place on the bushing, with tang 5*a* in a mating hole (not sown) in bushing 4. The clutch assembly is slipped on the bushing and over the seal rings which are observable without the housing. The assembler normally grasps upper shaft 2*h* and rocks the shaft about to encourage the entry of splines 2*f* into the mating splines 3*b* in each disc. That could agitate the thrust washer 5 and risks rocking tang 5*a* out of the mating hole similar to bolt hole 4*d* in bushing 4. By prior art methods, the thrust washer in not visible but rather is well down inside the housing (not shown) that is part of the assembly at that time. With the novel tooling, the washer can be observed and corrected if necessary. The assembly is then ready to install but there is no provision for retaining the parts axially while the assembly is placed in the housing. The threads 2*c* invite the use of a retainer for holding the assembly intact after it is assembled outside the transmission housing, and quite observable, as shown with tooling, which accepts pilot 2*d*, in place by FIG. 7.

Figure 4:
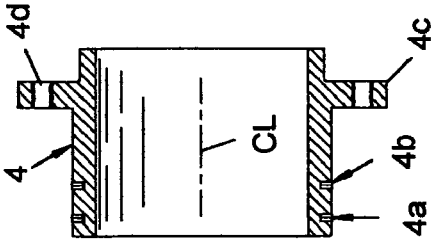
FIG. 4 is a side view, somewhat enlarged, of the most troublesome component.
Figure 3:
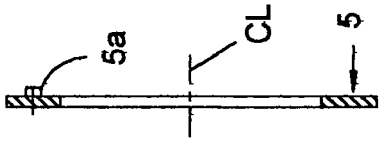
FIG. 3 is a side view, somewhat enlarged, of one of the more troublesome parts.
Figure 5:
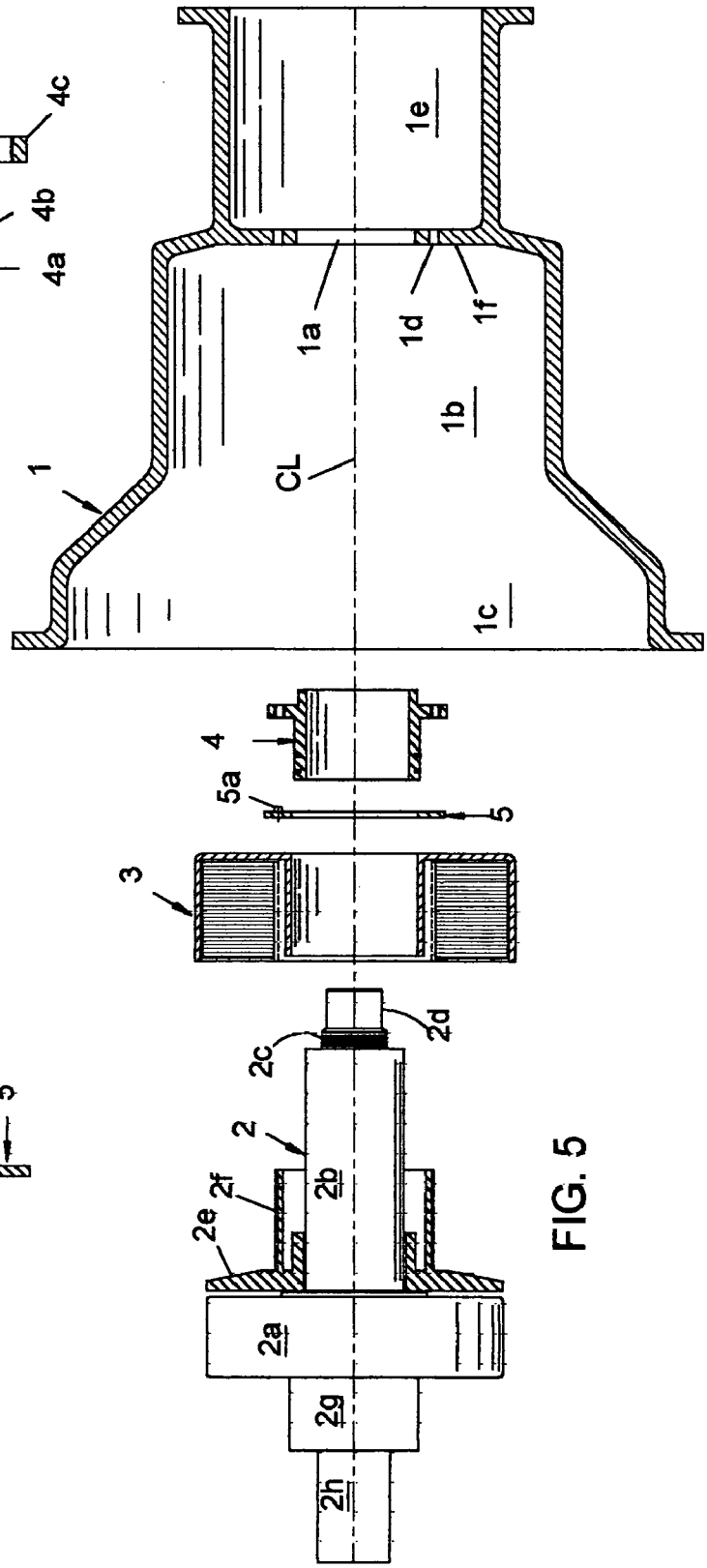
FIG. 5 is a side view, partly cut away, of the components of FIG. 2, with the housing.

FIG. 5 shows the parts of FIG. 2 distributed along the common center line CL of the housing 1 and parts 4 and 5 are enlarged in FIGS. 3 and 4 to show some details more clearly. Housing 1 has forward expansion 1*c*, the central opening 1*b*, rear extension 1*e* and the support barrier If. The bushing 4 mounts in bore 1*a* and is secured by cap screws in holes 1*d*. The transmission will operate some time with the thrust washer deranged but will cause transmission failure after some miles of use. There is a need to assemble all parts shown left of the housing before the assembly is placed in the housing.

Figure 6:
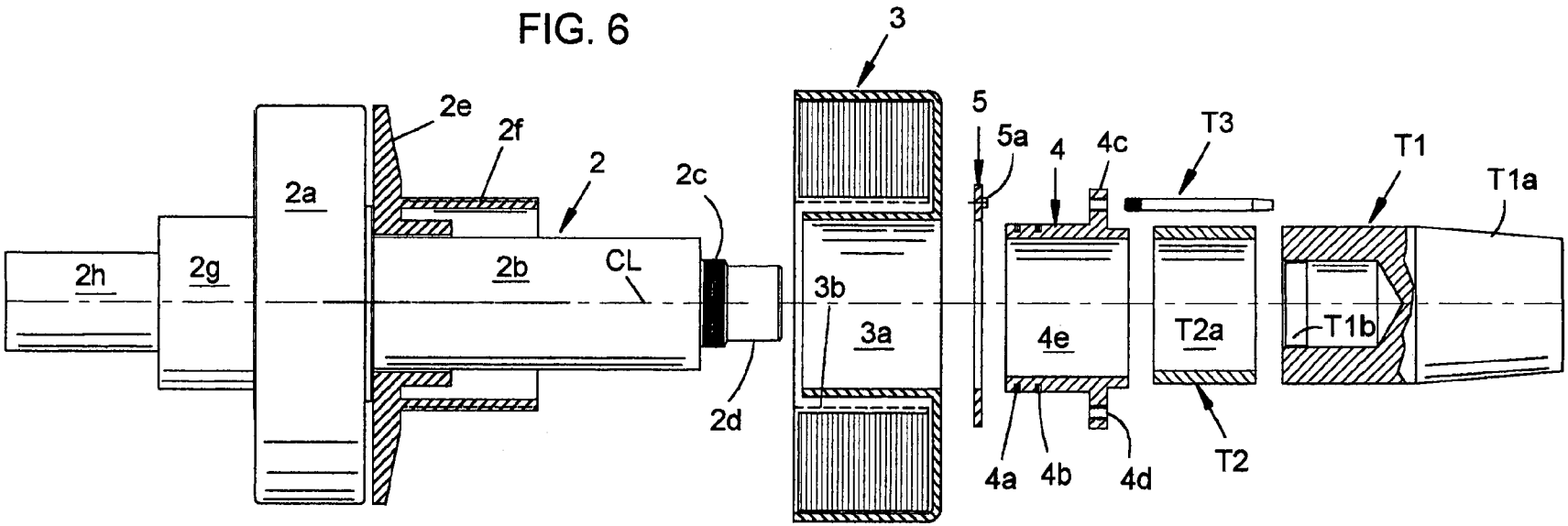
FIG. 6 is a side view the components of FIG. 2 with tooling used to ease assembly.

FIG. 6 shows all parts left of the housing in FIG. 5 and the novel tools needed to secure the assembly together for assembly into the housing. The tools include three parts, alignment spear T3, Spacer sleeve T2 and retaining spear T1. Spear T1 has threads T1*b* which engage threads 2*c* on the assembly 2. Room is provided in T1 to accept pilot 2*d*. Sleeve T2 is shown separate from spear T1 but can exist as an extension on the end of T1. Extension 2*b* extends through bores 4*e* and T2*a*

Figure 7:
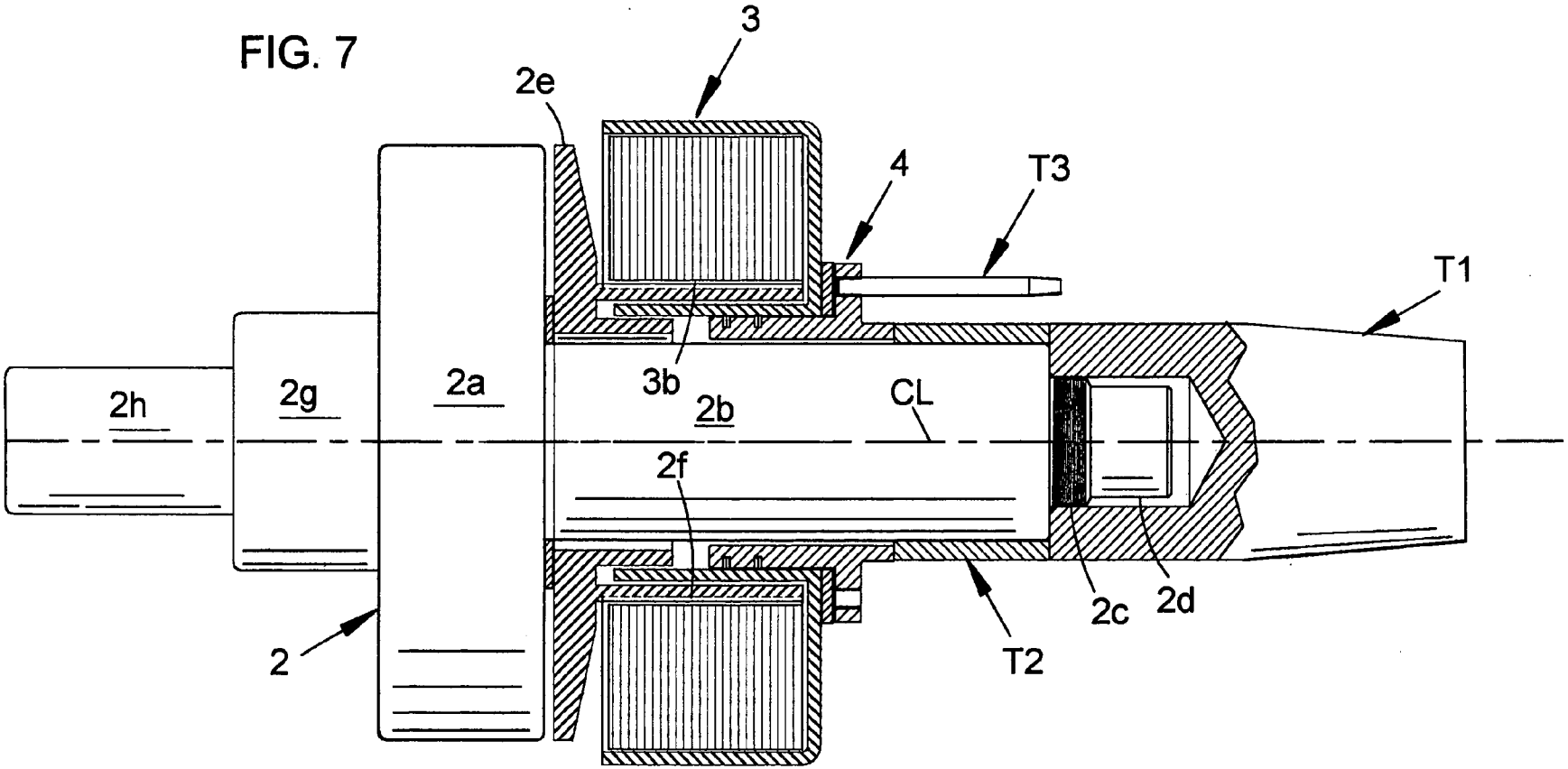
FIG. 7 is a side view of the components of FIG. 2 assembled with the tooling.

FIG. 7 shows the assembled parts, with the tools in place for insertion of the entirety into the housing. All of FIG. 7 is assembled outside the housing and the seals and thrust washer can be observed during and after assembly to assure correctness of the relationship of the parts. Alignment of the bolt holes of bushing 4 is assured by spear T3. All tool parts are removed after the assembly is placed in the housing. No juggling of the assembly is necessary after the assembly shown is properly secured in the housing.

Figure 8:
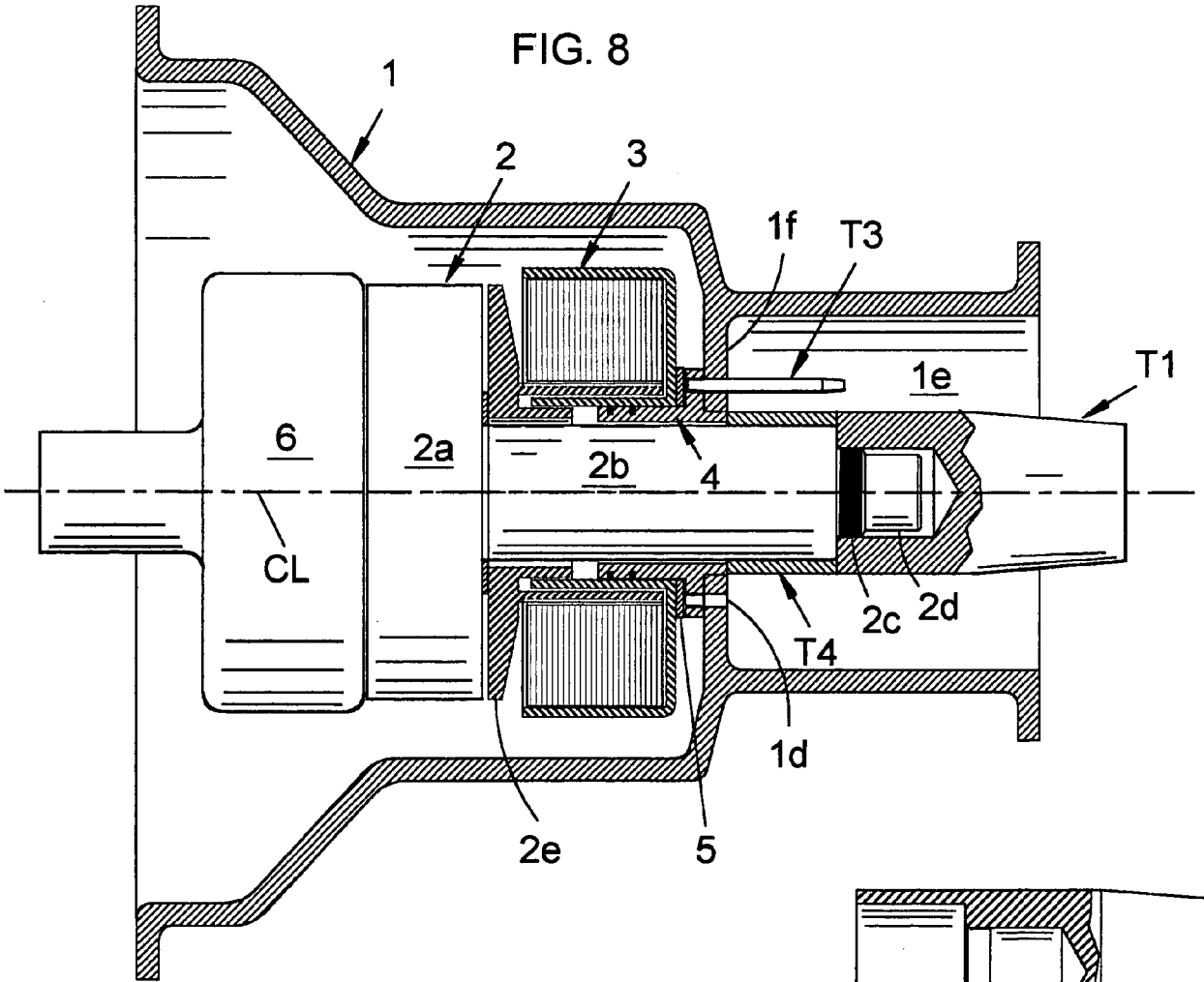
FIG. 8 is a side view of the assembled transmission, with tooling still in place.

FIG. 8 shows the assembly, prepared outside the housing, after insertion into the housing but with the tools still in place. Forward assembly 6 is shown, representing further preparation of the transmission, but is not part of the novelty presented. Removal of spear T3 and installation of cap screws into holes 1*d* usually precedes removal of tool parts T1 and T2.

Figure 9:
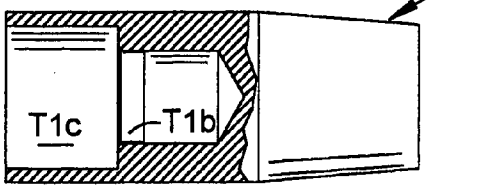
FIG. 9 is a side view, mostly in cut-away, of a combined form of tool component.

FIG. 9 shows a combined form of tool parts T1 and T2. The left end is extended with the inside and outside dimensions of tool part T2.

These and other objects, advantages, and features of this invention will be apparent to those skilled in the art from a consideration of this specification, including the attached claims and appended drawings.

It will be understood that certain features and sub-combinations are of utility and may be employed without reference to other features and sub-combinations. This is contemplated by and is within the scope of the claims.

As many possible embodiments may be made of the tool set of this invention without departing from the scope thereof, it is to be understood that all matter herein set forth or shown in the accompanying drawings is to be interpreted as illustrative and not in a limiting sense.

The invention having been described, I claim:

1. A tooling set to enhance the assembly of automatic transmissions for automobiles, the tool set to secure a combination comprising the rear planetary gear assembly, an oil bushing, thrust washer, and rear clutch assembly to be then installed in a housing, the tool set comprising:

a) an elongated guide spear with one end threaded to engage threads on the oil bushing, and pass through bolt holes in the housing;

b) a main spear to engage threads on the planetary gear assembly and to extend along the common center line of the planetary gear assembly;

c) a spacer bushing to extend from the main spear to engage the oil bushing;

whereby the rear clutch assembly can be installed on the oil bushing resulting in an assembly which can be assembled outside the housing with seals and thrust washer visible, then installed in the housing, the tooling set then removable for further processing of the overall transmission assembly.

2. The tool set according to claim 1 wherein the transmission is a Mercedes automobile transmission.

3. The tool set according to claim 1 wherein said oil bushing is arranged for mounting on, and securing to, the housing to support the components of said combination.

4. The tool set according to claim 3 wherein the flange has holes to accept fasteners to secure the bushing to the housing, one of said holes to accept said elongated guide spear.

5. The tool set according to claim 1 wherein said spacer bushing is an extension on said main spear.

6. The tool set according to claim 1 wherein said spacer bushing is an extension on said main spear.

7. The tool set according to claim 1 wherein the transmission is a Mercedes automobile transmission.

8. A tooling set to enhance the assembly of automatic transmissions for automobiles, the tool set to secure a combination of a rear clutch assembly, an oil bushing arranged to bearingly support the rear clutch assembly, a thrust washer captured on the oil bushing, and rear planetary gear assembly to be then installed in a housing, the tool set comprising:

a) an elongated guide spear with threads to engage mating threads on the oil bushing and pass through bolt holes in the housing;

b) a main spear to engage threads on the planetary rear assembly and to extend along the common center line of the planetary gear assembly;

c) a spacer bushing to extend from the main spear to engage the oil bushing;

whereby the rear clutch assembly can be installed on the oil bushing resulting in an assembly which can be assembled outside the housing with seals and rust washer visible, then installed in the housing, the tooling set then removable for further processing of the overall transmission assembly.

9. A tooling set to enhance the assembly of automatic transmissions for automobiles, the tool set to secure a combination comprising the rear planetary gear assembly, an oil bushing, thrust washer, and rear clutch assembly to be then installed in a housing, the tool set comprising:

a) the oil bushing, provided with surfaces to mount on the housing and cooperate with fasteners to secure it to the housing;

b) an elongated guide spear with one end threaded to engage threads on the oil bushing, and pass through bolt holes in the housing;

c) a main spear to engage threads on the planetary gear assembly and to extend along the common center line of the planetary gear assembly;

d) a spacer bushing to extend from the main spear to engage the oil bushing;

whereby the rear clutch assembly can be installed on the oil bushing resulting in an assembly which can be assembled outside the housing with seals and thrust washer visible, then installed in the housing, the oil bushing securable to the housing, and the tooling set then removable for further processing of the overall transmission assembly.

* * * * *